US005363016A

United States Patent [19]

James

[11] Patent Number: 5,363,016

[45] Date of Patent: Nov. 8, 1994

[54] COOLED REENTRANT TWT LADDER CIRCUIT HAVING AXIALLY RAISED COOLING BARS

[75] Inventor: Bertram G. James, Redwood City, Calif.

[73] Assignee: Varian Associates, Inc., Palo Alto, Calif.

[21] Appl. No.: 767,597

[22] Filed: Sep. 30, 1991

[51] Int. Cl.[5] ..... H01J 23/24; H01J 23/087

[52] U.S. Cl. ..... 315/3.5; 315/5.35; 313/22; 313/36

[58] Field of Search ..... 315/3.5, 39.3, 5.35; 313/35, 36, 30, 22

[56] References Cited

U.S. PATENT DOCUMENTS 3,246,190 4/1966 Boyd et al. ..... 315/3.5 X
3,449,618 6/1969 Gallagher ..... 315/3.5 X
3,617,798 11/1971 Marchese et al. ..... 315/3.5
4,746,833 5/1988 King et al. ..... 315/3.5
4,748,377 5/1988 King ..... 315/3.5
4,891,556 1/1990 Iwamoto ..... 315/3.5

*Primary Examiner*—Benny T. Lee
*Attorney, Agent, or Firm*—Francis H. Lewis; Gerald M. Fisher; David J. Power

[57] ABSTRACT

A PPM coupled-cavity traveling wave tube has an RF structure comprising a re-entrant double-staggered ladder circuit. Several cavities are separated by iron pole pieces with penetrating slots to provide RF coupling between the cavities. Re-entrant copper bars are attached to both sides of the pole pieces that define the boundaries between adjacent pairs of cavities. These bars extend diametrically across the cavity interior around beam drift tubes The re-entrant bars on adjacent pole pieces are rotated relative to each other by 90 degrees about the beam axis. The bars are hollow along their length, and thereby provide channels for coolant flow around the drift tubes. These channels communicate through apertures with coolant distribution channels in the outer cavity walls extending along the length of the traveling-wave tube.

11 Claims, 4 Drawing Sheets

COOLED REENTRANT TWT LADDER CIRCUIT HAVING AXIALLY RAISED COOLING BARS

BACKGROUND OF THE INVENTION

1. Field of the Invention

This invention pertains generally to the field of slow-wave structures for a traveling-wave tube (TWT), and more particularly, to re-entrant ladder-type coupled-cavity circuits with periodic permanent magnet (PPM) focusing having direct liquid cooling of the beam tunnel.

2. Description of the Background Art

Coupled-cavity TWT structures are advantageously and widely utilized in the design of high-power wide-band amplifiers. In the "ladder-type" coupled-cavity circuits, the periodic interaction elements resemble the rungs of a ladder extending across a hollow tube. The spaces between the rungs constitute the cavities, and coupling apertures between adjacent cavities are defined by the spaces around the rungs. The bandwidth of the structure increases with increasing intercavity coupling. By providing PPM focusing of the beam, it is possible to design a compact lightweight structure having the above advantages of high power and good bandwidth characteristics. Such TWT's combine the PPM periodicity with that of the RF circuit, the magnetic circuit forms a part of the cavity structures.

One typical ladder structure is disclosed in U.S. Pat. No. 4,409,519 issued Oct. 11, 1983 to Arthur Karp. This patent discloses a structure with wide rungs and coupling apertures staggered on alternating opposite sides of the rungs so that each cavity is coupled only to its immediately neighboring cavities. This staggered coupling increases the usable bandwidth of the structure. The wide rungs also allow heat conduction in two dimensions away from the beam tunnel, thereby improving the thermal properties of the tube.

A double staggered ladder circuit is disclosed in U.S. Pat. No. 4,586,009 issued Apr. 29, 1986 to Bertram G. James, who is also the present inventor. This structure includes two coupling apertures between each pair of adjacent cavities. The relative locations of these apertures are rotated by 90 degrees about the beam axis in successive intercavity interfaces. This double coupling further increases the bandwidth of the system.

Another type of double coupling is disclosed in U.S. Pat. No. 4,866,343 issued Dec. 2, 1980 to Arthur Karp. This structure is the "comb-quad" circuit, which comprises two mutually orthogonal ladders with their rungs interleaved. There are construction difficulties in aligning the components of this structure. Further, the heat conduction away from the beam tunnel occurs essentially in one-dimension along the rungs or "teeth" of the comb, and this limits the average power at which the tube can operate.

A further improvement on the double-staggering design is disclosed in U.S. Pat. No. 4,866,343 issued Sep. 12, 1989 to Bertram G. James, the present inventor. This improvement is termed the "Re-Entrant Double-Staggered Ladder Circuit", in which each plate or "wall" between adjacent cavities has a wide transverse ridge on either side enclosing the axial beam aperture. The ridges are orthogonal to the coupling slots in these walls, and the slots and ridges in neighboring plates are rotated by 90 degrees about the beam axis relative to each other. These re-entrant ridges increase the efficiency and bandwidth of the traveling wave tube.

All of the foregoing cited United States patents are assigned to the assignee of the present invention.

In all of the traveling-wave tubes discussed above, the average power capability is limited by the heat generated from the interception of the electron beam by portions of the RF structure. This heat must be conducted away from the beam by the structure, and therefore the structure must have good thermal conducting properties to maximize the operating power of the tube. Copper is often used in these structures because of its high thermal conductivity.

In coupled-cavity PPM TWT's, heat is generated by the electron beam interception in the iron pole pieces, which have lower thermal conductivity than copper. In order to improve the thermal conduction path away from the electron-beam tunnel, a ferrule bar may be utilized, as described in the article by Alan Griggs entitled "A New Coupled-Cavity Circuit for High Mean Power Traveling-Wave Tubes", *IEEE Transactions on Electron Devices*, Vol. 38, No. 8, Aug. 1991, pp. 1952–1957. This ferrule bar is essentially a high-conductivity copper bar extending from the iron ferrule around the beam to the outer copper cavity wall, which is in contact with coolant channels. The author states that this technique is useful at operating frequencies that exceed 4 GHz, the maximum frequency at which direct liquid cooling of the beam tunnel is feasible. For frequencies greater than 4 GHZ, the article reports that the ferrule bar technique improves the mean power capability of the tube by a factor ranging from 1.5 to 3, depending on the frequency.

When the frequency substantially exceeds approximately 30 GHz, the intercavity walls become too thin to serve as magnetic pole pieces. The magnetic circuit is then made external to the RF structure, and the cavity walls are made of copper. In this high frequency region, the increase in available mean power from the ferrule bar technique would be less significant, but it is still useful.

Other designs have been utilized to increase the thermal capacity of PPM coupled-cavity circuits. These designs include laminated plates of copper and iron serving as the pole pieces, and the use of water channels and heat pipes through the pole pieces. These techniques are useful to some degree, but they are limited either because of mechanical restrictions in that thick pole pieces are required, or because in tubes operating at high frequencies the structure must be made so small that the design is not practical.

SUMMARY OF THE INVENTION

The present invention provides a re-entrant double staggered ladder circuit for PPM focused coupled-cavity traveling-wave tubes, with direct liquid cooling. The re-entrant bars are hollow, and provide channels for coolant flow. These bars extend diametrically across the cavity interior around the beam drift tubes to provide direct cooling. The channels of the bars communicate through apertures with coolant channels in the cavity walls to provide a continuous flow of coolant through all of the bars.

An object of this invention is to provide a PPM coupled-cavity traveling wave tube that operates at higher power levels for all frequencies, compared to previous PPM-focused TWT's. An additional object is to provide the advantages of re-entrant double staggered ladder circuits of previous devices.

These and other objects, advantages, characteristics and features of this invention may be better understood by examining the following drawings together with the detailed description of the preferred embodiments.

DETAILED DESCRIPTION OF THE PREFERRED EMBODIMENTS

Figure 1:
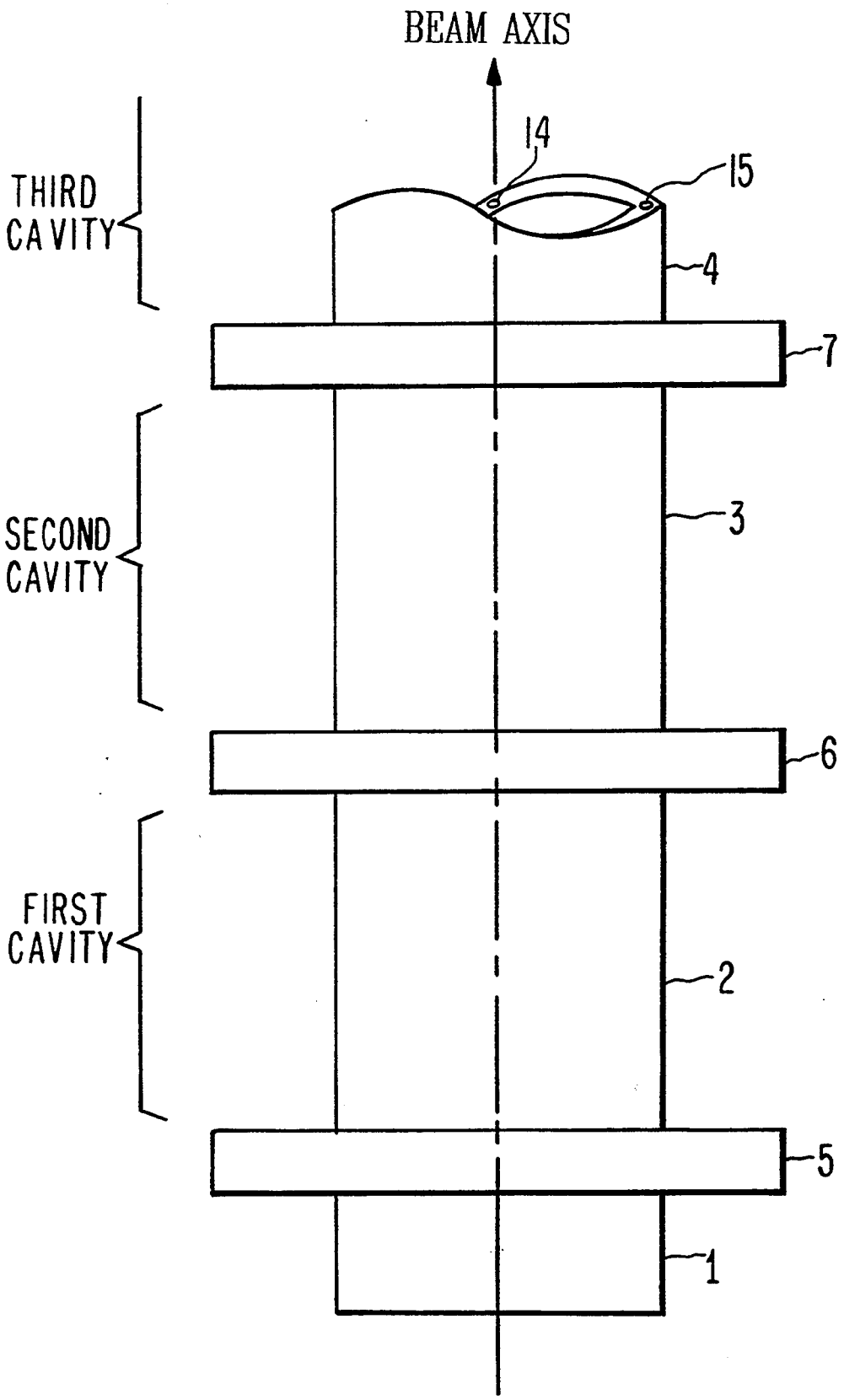
FIG. 1 is a top view of the first two cavities, and a part of the third cavity, of a PPM coupled-cavity traveling-wave tube according to the present invention.
Figure 2:
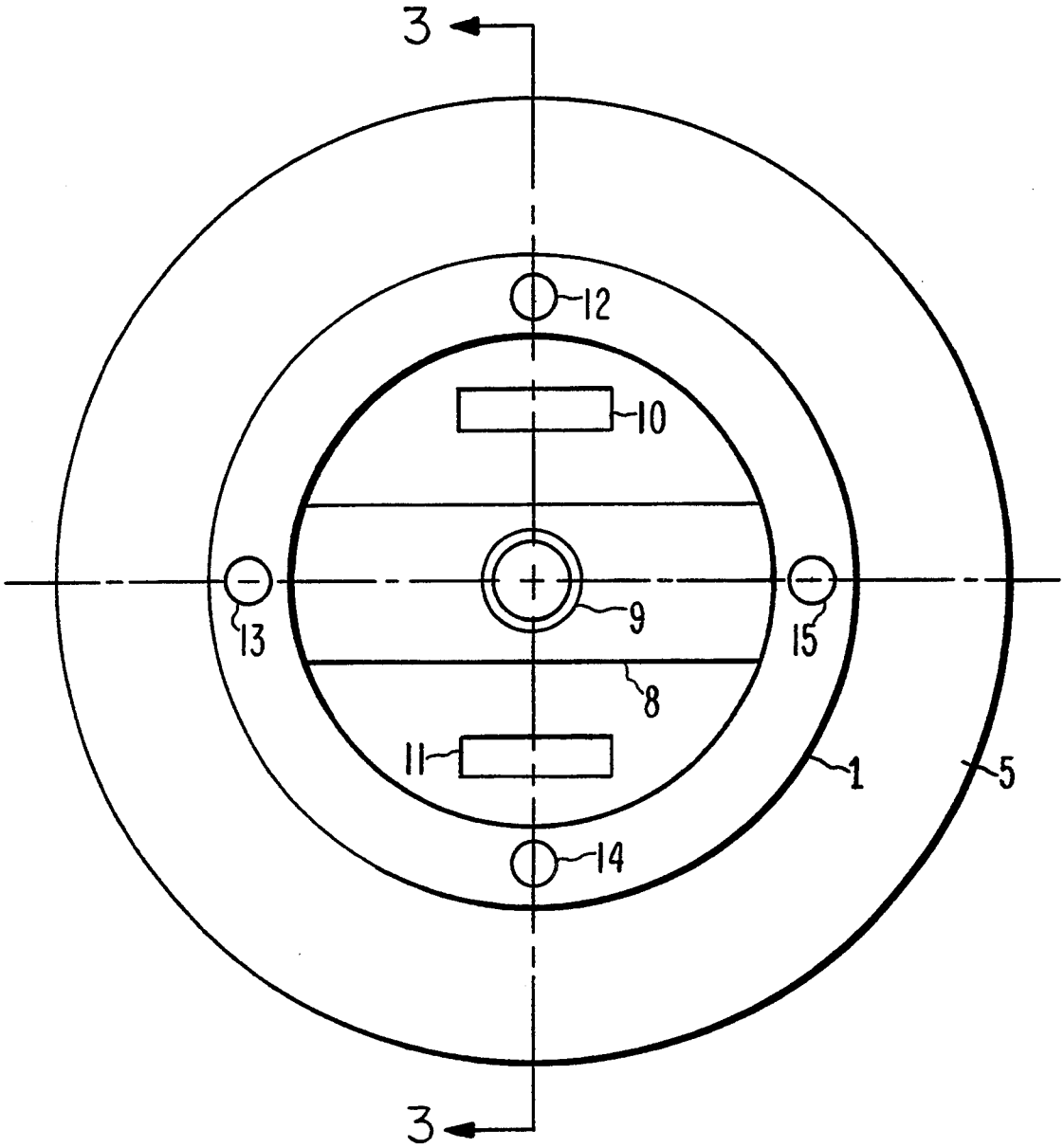
FIG. 2 is an end view of the TWT of FIG. 1, viewed along the direction of the beam line.
Figure 3:
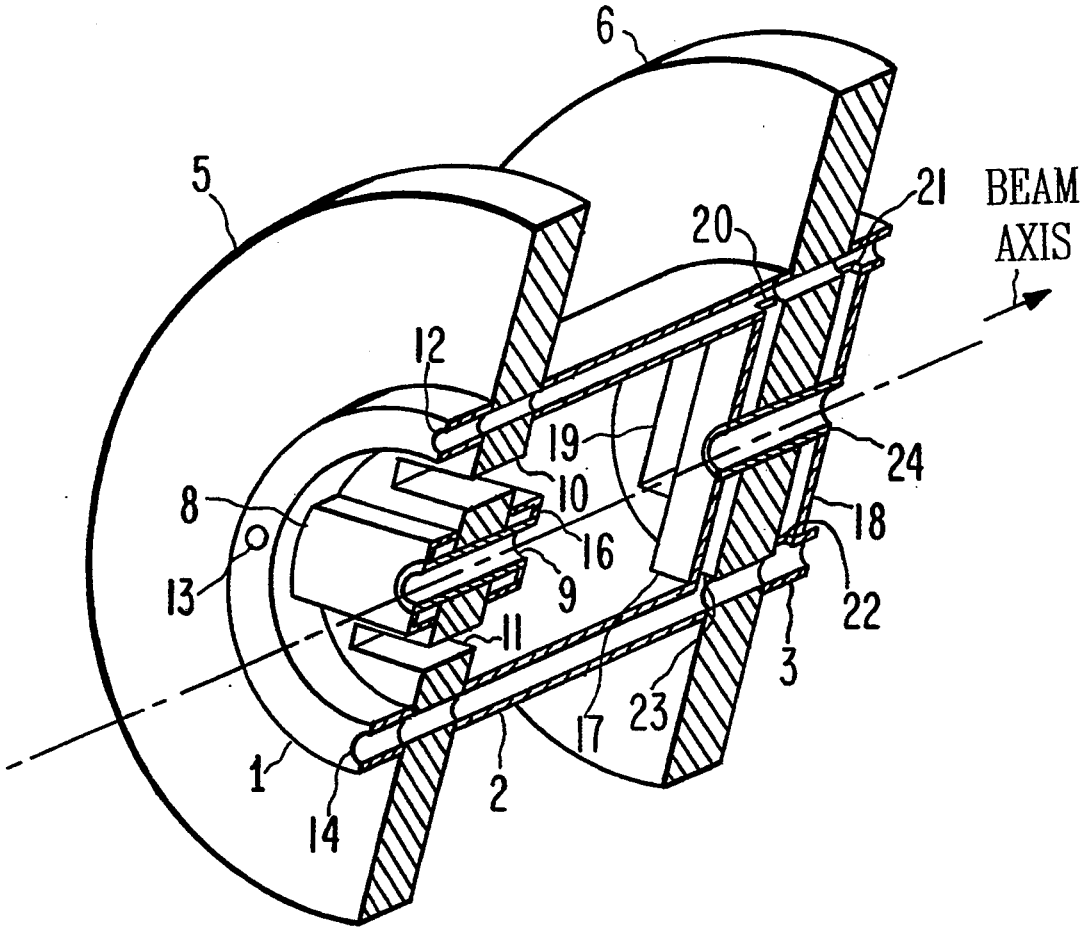
FIG. 3 is an oblique sectional view of the first cavity of the TWT of FIGS. 1 and 2, where the section is taken along the sectional lines 3—3 shown in FIG. 2.

FIGS. 1, 2, and 3 show the re-entrant double-staggered ladder circuit structure for the first two cavities of the PPM coupled-cavity traveling-wave tube. For simplicity the electron gun, collector, ports, power supplies and other common components of a TWT are omitted. The circuit has cylindrical cavity sections defined by copper cylinder walls 1, 2, 3, 4, as shown in FIG. 1 with cylinder axes coincident with the common beam axis which locates the center of a typical beam of electrons in the tube. The cavities are separated by end walls constituting magnetic pole pieces 5, 6, 7, which are fabricated preferably from iron or other magnetic material and are spaced periodically to form the PPM focusing structure. For example, the first cavity section is defined by cylindrical wall 2 and the cylinder ends 5, 6.

Drift tubes 9, 24 are aligned along the beam axis and pass through the centers of the pole pieces 5, 6 in FIG. 1 to provide beam apertures for passage of a charged particle beam through the end walls 5, 6 of the cavities, as shown in FIG. 3. RF coupling between cavities is provided by coupling slots 10, 11, 19 in the end wall pole pieces, 5 and 6. In the first pole piece 5, coupling slots 10 and 11 are both perpendicular to the beam line and mutually parallel and are located on opposite sides of the beam line. Coupling slot 19 in the next pole piece 6 is transverse to the beam line as shown in FIG. 3. Another coupling slot in this pole piece 6, not shown in the drawings, is parallel to this slot 19 and is located on the opposite side of the beam line. The coupling slot 19 in the second pole piece 6 is rotated by 90 degrees about the beam axis relative to the coupling slots 10, 11 in the first pole piece 5. In a similar manner, the coupling slots in each successive pole piece are rotated by 90 degrees relative to the neighboring slots so that only adjacent cavities are coupled. The slots in alternate walls are axially aligned.

Coolant channels 12, 13, 14, 15, as shown in FIG. 2 and 3 are provided inside the cylinder walls 1, 2, 3, 4, and through tile pole pieces 5, 6, 7, running parallel to the beam axis along the entire length of the tube through all the cavity sections. These channels 12, 13, 14, 15 are azimuthally disposed about the beam axis at 90 degree intervals. Re-entrant bars 8, 16, are attached to opposite sides of the pole piece cavity wall 5 and extend across the cavity interior around the drift tube 9, perpendicular to the beam axis. In a similar manner, re-entrant bars 17, 18 are attached to opposite sides of the adjacent pole piece 6 and extend diametrically across the cavity around the drift tube 24. These re-entrant bars 8, 16, 17, 18 as shown in FIG. 3 are made of copper, and are attached at diametrically opposite positions on the interior cylinder walls 1, 2, 3, 4. The re-entrant bars 8, 16 attached to the first pole piece 5 intersect the cavity walls 1, 2 respectively, at the azimuthal locations of the diametrically opposed coolant channels 13 and 15. Similarly, the re-entrant bars 17, 18 attached to the second pole piece 6 intersect the cavity walls 2, 3, respectively, at the azimuthal locations of the diametrically opposed coolant channels 12 and 14.

The re-entrant bars 8, 16, 17, 18 are hollow, and the interiors of the bars 8, 16, 17, 18 provide channels for coolant flow. At the locations where the bars 8, 16, 17, 18 meet the cavity walls 1, 2, 3, apertures in the walls 1, 2, 3 are provided so that the coolant channels 12, 13, 14, 15 communicate with these interior channels to supply a flow of coolant to the bars 8, 16, 17, 18. For example, as shown in FIG. 3, apertures 20, 23 in the interior cavity wall 2 lie at the points where the ends of the re-entrant bar 17 intersect this wall 2, and allow coolant to flow between coolant channels 12 and 14 through this bar 17. Similarly, the apertures 21, 22 in the cavity wall 3 allow coolant to flow between coolant channels 12 and 14 through the re-entrant bar 18. A corresponding set of apertures are provided in the cavity walls 1, 2 at the locations of the re-entrant bars 8, 16 to allow coolant flow between the coolant channels 13 and 15 through these bars 8, 16. These apertures are not shown in the drawings. Similar apertures are provided along the entire length of the tube. Coolant fluid is supplied to the coolant channels by the usual means and flows through all the re-entrant bars.

This PPM ladder circuit allows the traveling-wave tube to operate at much higher levels of average power compared to previous devices, because fluid coolant flow is supplied directly to the drift tubes 9, 24, the components where the heat generation tends to be the largest. The thermal capacity is further increased by the high thermal conductivity of the copper re-entrant bars 8, 16, 17, 18 themselves. This innovation can be implemented in circuits operating at high frequencies since the cooling structure does not depend on the thickness of the pole pieces 5, 6, or any of their other physical characteristics. In addition, the circuit retains all the advantages of previous re-entrant structures, including increased mutual capacitance between ladder rungs, greater bandwidths and improved efficiencies.

Figure 4:
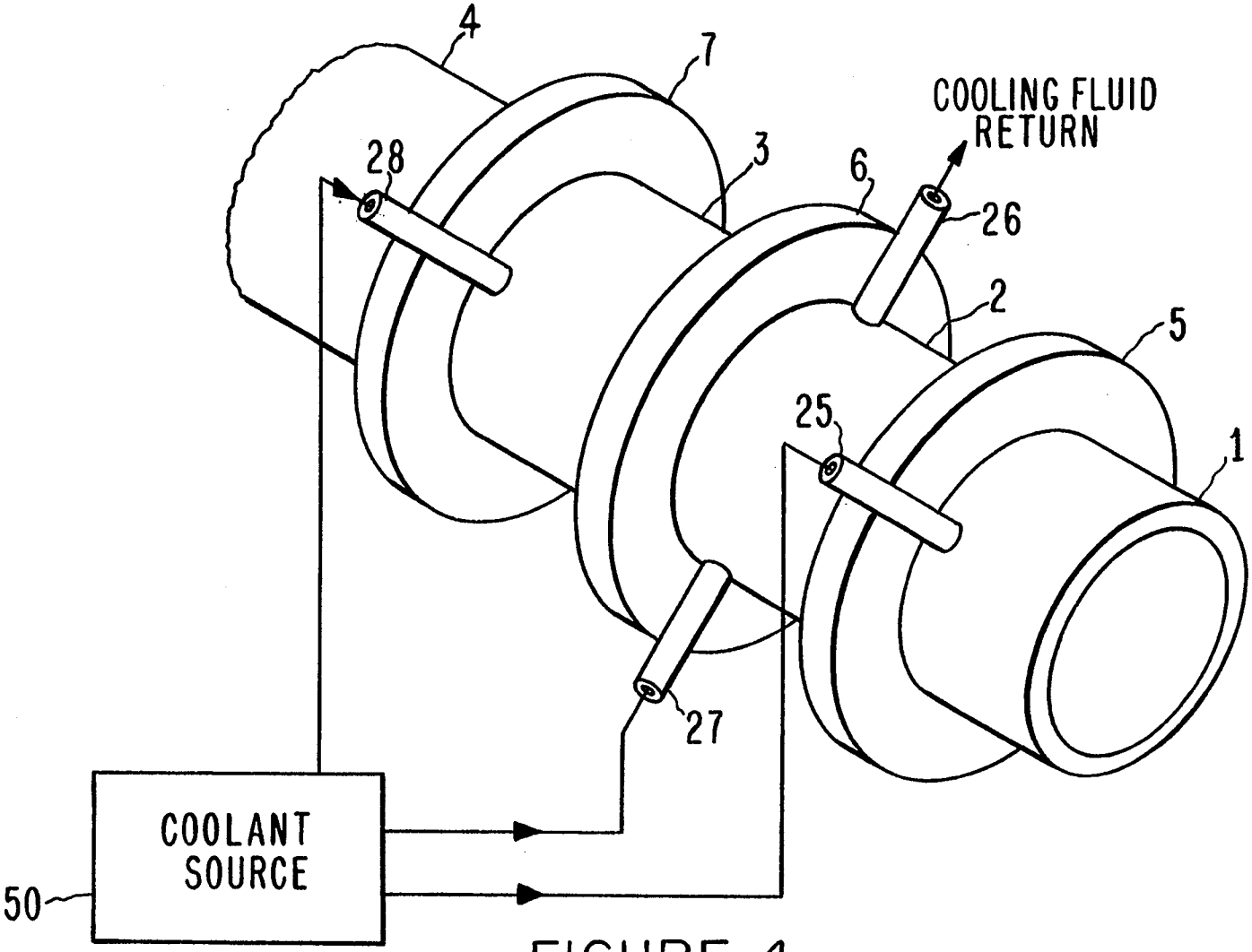
FIG. 4 is an oblique view of an alternative version of a PPM coupled-cavity traveling-wave tube, showing the first two cavities and a part of the third cavity.

An alternative version of the invention is shown in FIG. 4, which shows an external oblique view of the first two cavity sections. This version has no coolant channels in the cavity walls 1, 2, 3, 4, and coolant is supplied to the re-entrant bars through tubes 25, 26, 27, 28 passing through these walls. Tubes 26 and 27 supply coolant to the re-entrant bars 17 and 18, while tube 25 and another tube not seen from the view of FIG. 4 supply coolant to the re-entrant bars 8 and 16. FIG. 4 does not show the internal passages through the pole pieces 5, 6, 7 that allow the coolant to flow from the re-entrant bar on one side of each pole piece to the re-entrant bar on the opposite side. Also omitted from the Figure for simplicity is the external piping necessary to distribute coolant to the various supply tubes 25, 26, 27, 28. Coolant supply 50 is shown connected to supply tubes 25, 27, and 28.

The foregoing disclosure of the preferred embodiments of the invention has been presented for purposes of illustration and description. It is not intended to be exhaustive or to limit the invention to the precise form disclosed, and, obviously, many modifications and variations are possible in light of the above teaching. The embodiments were chosen and described in order to best explain the principles of the invention and its practical applications to thereby enable others skilled in the art to best utilize the invention in various embodiments and with various modifications as are suitable to the particular use contemplated. It is intended that the spirit and scope of the invention are to be defined by reference to the claims appended hereto.

What is claimed is:

1. In a circuit for a cooled PPM traveling-wave tube for cooperating, in operation, with a beam of charged particles, said circuit comprising:

a hollow enclosed channel having a central axis comprising a plurality of pairs of nested concentric cylinder walls of different diameters defining a first cooling passage traversing the space between said cylinder walls, the central axis of said hollow enclosed channel extending along to coincide with a central longitudinal axis associated with said tube, thereby defining a single central axis, said hollow enclosed channel being comprised of a series of sections, each section being a conductive portion of said hollow enclosed channel, and an array of wall members having faces transverse to said single central axis extending along said hollow enclosed channel, each respective wall member being respectively disposed between and connecting adjacent sections of said hollow enclosed channel to define a respective cavity in each of said sections, said wall members having beam apertures aligned with respect to said single central axis for passage, in operation, of a beam of charged particles, each said array of wall members including;

a first set of said wall members having a first set of flow apertures therethrough, said flow apertures having an axis parallel to said single central axis and near a first side of said hollow enclosed channel, said first set of wall members having axially raised bars extending across opposing faces of said first set of said wall members transverse to the orientation of said axis of said flow apertures and surrounding said beam apertures;

a second set of said wall members interleaved with said first set along said single axis, said second set of said wall members also having said first flow apertures therethrough, said second set of walls having bars respectively transverse to the orientation of the bars of said first set of wall members, said bars being axially raised and extending across opposed faces of said respective second set of said wall members, transverse to the orientation of the axis of said flow apertures and surrounding said beam apertures;

each of said bars having a length and a width, said bars each having a hollow interior defining a corresponding second coolant passage along said length of said respective bar; and a conduit means for connecting said first cooling passage to said corresponding second cooling passage for allowing an injected coolant material to flow through each of said bars in direct thermal contact with said beam apertures.

2. The circuit of claim 1, further comprising in each of said wall members a second flow aperture, said second aperture intersecting into said space between said cylinder walls of said hollow enclosed channel at a position removed from first flow aperture.

3. The circuit of claim 1, wherein each said axially raised bars are comprised of conducting material.

4. The circuit of claim 1, wherein each of said wall member comprises a corresponding magnetic pole piece, each said magnetic pole piece being a portion of the circuit for focusing said charged particle beam.

5. The circuit of claim 4, wherein each said axially raised bars are comprised of conducting material.

6. The circuit of claim 1, further comprising a plurality of penetrating channels extending out from said hollow enclosed channel, and wherein said penetrating channels are adapted to allow for injection of said coolant material by an external coolant supply.

7. An improved ladder circuit structure for a PPM coupled cavity TWT comprising:

a) a first cavity having an axis, and first cavity comprising a pair of concentric nested cylindrical electrically conducting tubes of different diameters including a smaller diameter tube wall and a larger diameter tube wall, each of said tubes being substantially of a same length and having one end of each tube lying in a single plane perpendicular to said axis, whereby the space between said tubes defining a first coolant channel, said space being at a radial distance R from said axis;

b) a pair of disk shaped magnetic pole pieces, each said disk shaped magnetic pole pieces having a pair of faces, one face of a respective one of said pair of magnetic pole pieces being mounted on a corresponding end of said cavity transverse to said cavity axis, each said pole piece having a central axially aligned aperture therethrough for passing, in operation, a beam of electrons, each said pole piece further including cylindrical apertures means there through, said cylindrical apertures means being radially displaced from said axis but being aligned parallel to said axis, said radial displacement being equal to said distance R so that said cylindrical aperture means opens into said first coolant channel; each said magnetic pole pieces further including respective RF coupling slots therethrough; and c) a plurality of reentrant highly conductive bars including a first said reentrant bar being affixed to one of the pair of faces in one of said magnetic pole piece discs and extending diametrically and transversely across said cavity, said bar having two ends, said bar passing through said smaller diameter tube wall at both ends of said bar, said first reentrant bar defining a second coolant channel, said second coolant channel being in flow communication with said first coolant channel.

8. The structure of claim 7 wherein said plurality of reentrant highly conductive bars includes a second reentrant bar being affixed to the other of a pair of faces in said one disk and extends parallel to said first reentrant bar and also passes through said smaller diameter tube wall at both ends of said second reentrant bar thereby defining a third coolant channel, said third coolant channel being in flow communication with said first coolant channel.

9. The structure of claim 7 wherein said cylindrical aperture means is a plurality of radially displaced cylindrical apertures, wherein each of said plurality of radially displaced cylindrical apertures respectively open into said first coolant channel.

10. The structure of claim 9 further including a second cavity and a third cavity, said second and third cavities being configured to be identical to said first cavity, each said second and third cavity being respectively mounted between the other face of a corresponding one of said pole pieces and a further respective pole piece disk, and wherein all said cavities are aligned so that each of said first coolant channels of each said cavity are in fluid communication with each other through said radially displaced cylindrical aperture means.

11. The structure of claim 10 wherein each said pole piece disk pair of reentrant bars is respectively mounted at exactly a 90° relationship relative to said reentrant bars on both adjacent pole pieces.

* * * * *